US009295996B2

(12) United States Patent
Kinle

(10) Patent No.: US 9,295,996 B2
(45) Date of Patent: Mar. 29, 2016

(54) SHOWER HEAD WITH BLOCKABLE CONTROL DISC ROTARY MOVEMENT

(71) Applicant: Hansgrohe SE, Schiltach (DE)

(72) Inventor: Ulrich Kinle, Schenkenzell (DE)

(73) Assignee: Hansgrohe SE, Schiltach (DE)

( * ) Notice: Subject to any disclaimer, the term of this patent is extended or adjusted under 35 U.S.C. 154(b) by 229 days.

(21) Appl. No.: 14/255,577

(22) Filed: Apr. 17, 2014

(65) Prior Publication Data

US 2014/0319248 A1 Oct. 30, 2014

(30) Foreign Application Priority Data

Apr. 26, 2013 (DE) ..... 10 2013 207 687

(51) Int. Cl.

*B05B 1/34* (2006.01)
*B05B 1/16* (2006.01)
*B05B 12/06* (2006.01)
(Continued)

(52) U.S. Cl.

CPC ..... *B05B 1/1636* (2013.01); *B05B 1/083* (2013.01); *B05B 1/14* (2013.01); *B05B 1/16* (2013.01); *B05B 1/1627* (2013.01); *B05B 1/1645* (2013.01); *B05B 1/1672* (2013.01); *B05B 1/18* (2013.01); *B05B 1/3013* (2013.01); *B05B 3/02* (2013.01); *B05B 3/04* (2013.01);
(Continued)

(58) Field of Classification Search

CPC ..... B05B 1/1636; B05B 1/16; B05B 1/18; B05B 3/04; B05B 1/083; B05B 12/06; B05B 3/02; B05B 1/1645; B05B 1/1627; B05B 1/14; B05B 1/3013; B05B 1/1672; B05B 15/061; B05B 9/01

USPC ..... 239/99, 101, 380–383, 436, 437, 443, 239/447, 525, 530, 548, 556, 558, 562, 563

See application file for complete search history.

(56) References Cited

U.S. PATENT DOCUMENTS 4,010,899 A 3/1977 Heitzman
4,754,928 A * 7/1988 Rogers ..... B05B 1/1645 239/381

(Continued)

FOREIGN PATENT DOCUMENTS

DE 2652584 A1 6/1977
DE 102008015969 A1 9/2009

(Continued)

OTHER PUBLICATIONS

Official action of Jan. 29, 2014 in DE 1 0 2013 207 687.8.

(Continued)

*Primary Examiner* — Steven J Ganey
(74) *Attorney, Agent, or Firm* — Duane Morris LLP

(57) ABSTRACT

A shower head has a jet disc having fluid passage channels and a control disc arranged so as to be rotatably movable relative to the jet disc. The control disc has a control slot pattern by which the fluid passage channels are opened up or blocked individually or group-wise depending on the control disc rotary position. The control slot pattern and the fluid passage channels are matched to one another such that, in the event of rotation of the control disc, successively at least two different jet patterns are obtained for a fluid jet exiting from the jet disc. A manually operable blocking mechanism can selectively enable or block the control disc rotary movement in at least one blocking position which corresponds to an associated jet pattern.

12 Claims, 8 Drawing Sheets

Figure 1:
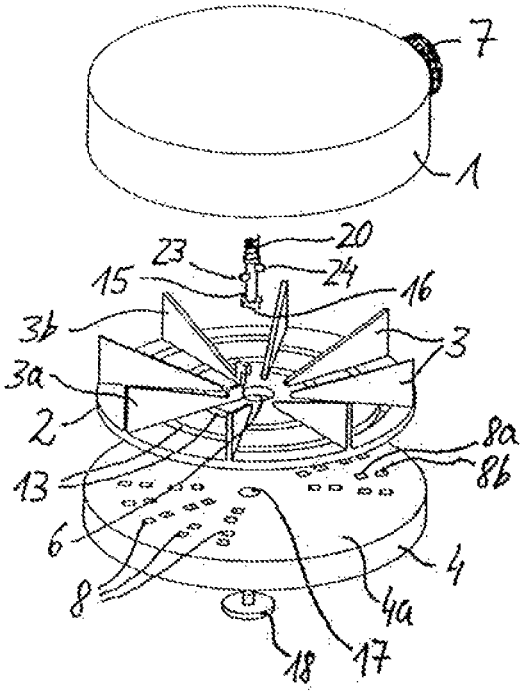

(51) Int. Cl.

| | |
|---|---|
| ***B05B 3/02*** | (2006.01) |
| ***B05B 1/08*** | (2006.01) |
| ***B05B 1/30*** | (2006.01) |
| ***B05B 1/14*** | (2006.01) |
| ***B05B 15/06*** | (2006.01) |
| ***B05B 9/01*** | (2006.01) |
| ***B05B 1/18*** | (2006.01) |
| ***B05B 3/04*** | (2006.01) |

(52) U.S. Cl.
CPC ..... *B05B 9/01* (2013.01); *B05B 12/06* (2013.01); *B05B 15/061* (2013.01)

(56) References Cited

U.S. PATENT DOCUMENTS

| | | | | |
|---|---|---|---|---|
| 4,801,091 | A * | 1/1989 | Sandvik | B05B 3/04 239/381 |
| 5,918,816 | A | 7/1999 | Huber | |
| 6,412,710 | B1 * | 7/2002 | Lin | B05B 1/1645 239/381 |
| 8,915,455 | B2 * | 12/2014 | Zhou | A61H 9/0021 239/383 |
| 2006/0032945 | A1 | 2/2006 | Clearman et al. | |
| 2010/0127096 | A1 | 5/2010 | Leber | |
| 2010/0257670 | A1 | 10/2010 | Hodel et al. | |
| 2014/0008462 | A1 | 1/2014 | Gransow et al. | |

FOREIGN PATENT DOCUMENTS

| | | | |
|---|---|---|---|
| DE | 102008015970 | A1 | 9/2009 |
| DE | 102011013534 | B3 | 3/2012 |
| EP | 0732148 | A2 | 9/1996 |
| EP | 0900597 | B1 | 1/2006 |
| WO | 0010720 | A1 | 3/2000 |

OTHER PUBLICATIONS

European Search Report dated Sep. 14, 2014 in Application EP 14165397.2.

* cited by examiner

Fig. 12
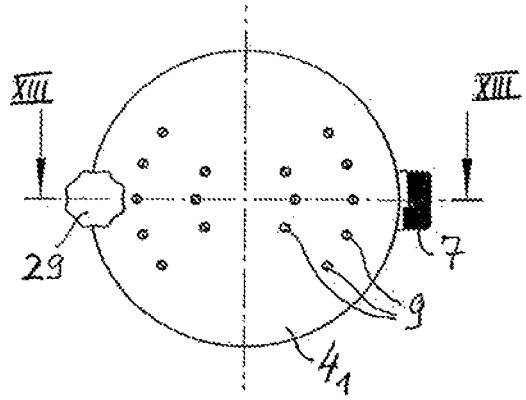
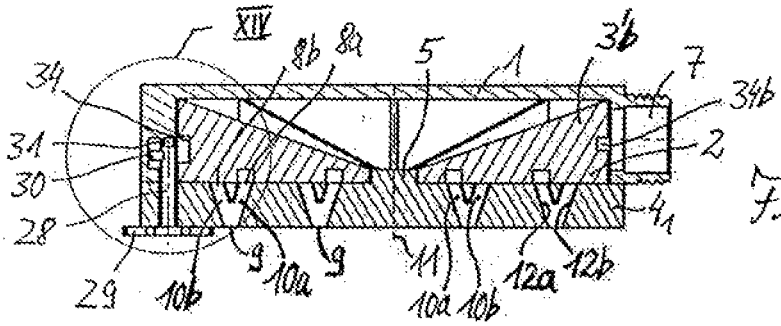
Fig. 13
Fig. 14
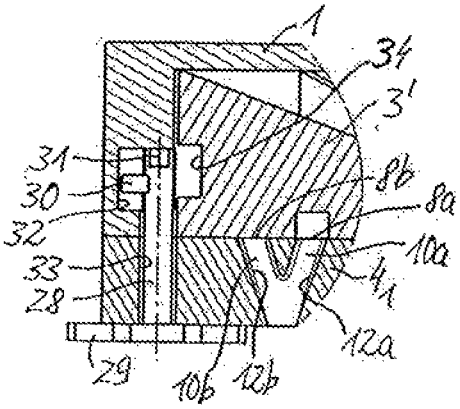
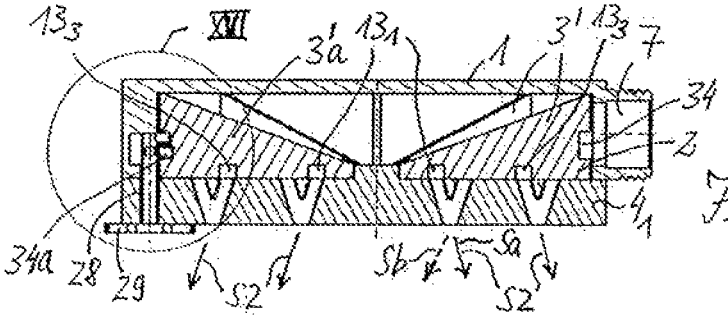
Fig. 15

SHOWER HEAD WITH BLOCKABLE CONTROL DISC ROTARY MOVEMENT

The invention relates to a shower head which comprises a jet disc having fluid passage channels and which comprises a control disc which is arranged so as to be rotatably movable relative to the jet disc and which comprises a control slot pattern by means of which the fluid passage channels are opened up or blocked individually or group-wise depending on the control disc rotary position, wherein the control slot pattern and the fluid passage channels are matched to one another such that, in the event of rotation of the control disc, successively at least two different jet patterns for a fluid jet exiting from the jet disc are obtained.

Shower heads of said type are used for example in the sanitary sector for handheld and overhead shower devices of shower and bath systems. Through the use of the control disc that is rotatably movable relative to the jet disc, the shower jet characteristic, that is to say the jet discharge characteristic of the shower head, can be configured so as to vary with time, which can be utilized for example to achieve a massage effect.

A shower head of said type is disclosed in the patent EP 0 900 597 B1. In the case of the shower head in said document, the function of a jet disc is performed by a rotor which is provided with a turbine blade structure and which has a closure element which extends in the circumferential direction over approximately half of the circumferential length. The jet disc is provided with passage channels which are of circular cross section and which, as the fluid-driven rotor rotates, are successively opened up or blocked by the closure element, wherein the closure element blocks or opens up in each case approximately half of the passage channels.

Various shower heads have also already been proposed which, for the variation of the shower jet characteristic with time, are equipped with movable jet outlet elements which are mounted rotatably and/or pivotably on a jet disc body, see for example the laid-open specifications DE 10 2008 015 970 A1, WO 00/10720 A1 and US 2006/0032945 A1 and the patent DE 10 2011 013 534 B3. Shower heads of said type require a corresponding number of jet outlet elements, which must be movably mounted in the jet disc body, and a relatively complex drive for said movable jet outlet elements.

The invention is based on the technical problem of providing a shower head of the type mentioned in the introduction which, with relatively little outlay, firstly permits an advantageous variation of the shower jet characteristic with time and secondly offers the possibility of realizing a constant setting of a desired shower jet characteristic.

The invention solves said problem through the provision of a shower head having the features of claim 1. Said shower head has a manually operable blocking mechanism by means of which the control disc rotary movement, that is to say the relative rotary movement between control disc and jet disc, can be selectively opened up or blocked, that is to say immobilized, in at least one blocking position which corresponds to an associated jet pattern.

The shower head according to the invention thus firstly, with the blocking mechanism in a release position, permits a continuous fluid-driven rotation of control disc and jet disc relative to one another and, in this way, a desired variation with time of the shower jet characteristic without it being necessary for this purpose to provide complex jet outlet elements mounted in rotationally movable fashion on the jet disc body. In this operating mode of the shower head, owing to the continuous rotation of the control disc relative to the jet disc, the different possible jet patterns of the fluid jet emerging from the shower head alternate periodically, this being effected by virtue of the different fluid passage channels being opened up and covered in alternating fashion by means of the control slot pattern. Secondly, in the shower head according to the invention, a constant setting of a desired jet pattern can be realized by virtue of the blocking mechanism being moved into the blocking position associated with said jet pattern, whereby said blocking mechanism stops the control disc rotary movement and immobilizes the control disc in the corresponding angular position.

In one refinement of the invention, it is possible for the user to selectively realize a constant setting of at least two different jet patterns. For this purpose, the blocking mechanism is configured for selectively blocking the control disc rotary movement in at least two different blocking positions which correspond to two different jet patterns.

In one refinement of the invention, the blocking mechanism has a manually operable blocking/actuation pin which is movably attached to the jet disc and/or to a housing of the shower head. By operation of said pin, the user can selectively enable the control disc rotary movement or immobilize said control disc in at least one blocking position.

In one refinement, the blocking/actuation pin comprises a plurality of radially projecting blocking stops on its circumference, said blocking stops being disposed offset to one another in pin circumferential direction and/or in pin axial direction. This constitutes a structurally simple and advantageous means for providing a plurality of different blocking positions for the control disc rotary movement.

In one refinement of the invention, the locking mechanism comprises a combined push/turn mechanism for the blocking/actuation pin. The pin can thus be operated in a similar manner to the push/turn mechanism known per se from ball-point pens, for example. In one advantageous refinement, the push/turn mechanism comprises a pushbutton which is received in an associated recess of the jet disc. In this way, the push/turn mechanism can be integrated into the jet disc contour in an advantageous manner from a design aspect.

In an alternative refinement of the invention, the blocking mechanism includes a rotation mechanism with a rotary actuation head projecting radially beyond the jet disc and/or the shower head housing. With this haptically advantageous measure, it is possible for the user to actuate the blocking mechanism in a very simple manner by rotating the radially projecting rotary actuation head.

In one refinement of the invention, the blocking stops provided on the blocking/actuation pin interact with a blocking structure which is configured on the control disc or on turbine blades co-rotationally coupled to the control disc. This makes it possible, with relatively little structural outlay, for the control disc rotary movement to be immobilized in one or several different blocking positions, depending on the application and requirements, by virtue of the blocking structure being designed correspondingly to the blocking stops. In one refinement, the blocking structure is configured at a radially internal or at a radially external side of the turbine blades, which are co-rotationally coupled to the control disc either by being formed integrally on the control disc or being co-rotationally attached thereto.

In a further refinement of the variant with blocking/actuation pin, the latter is radially movably attached to the jet disc or to a connection region or a handle region of the shower head housing. By means of the radial movement, the pin can selectively engage into the rotary movement of the control disc or be released from said rotary movement.

Figure 2:
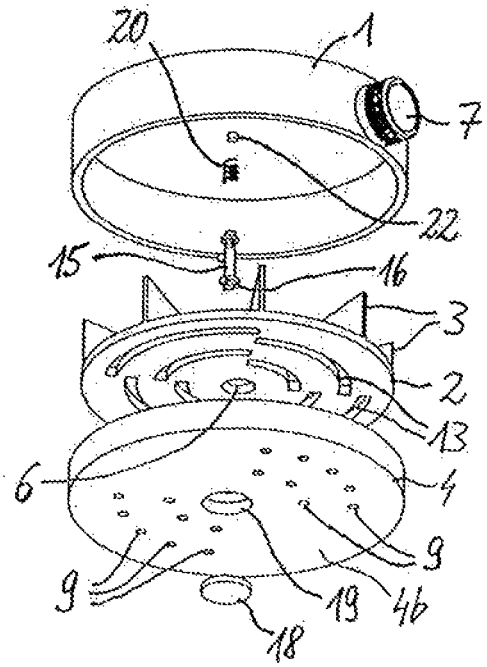
Figure 3:
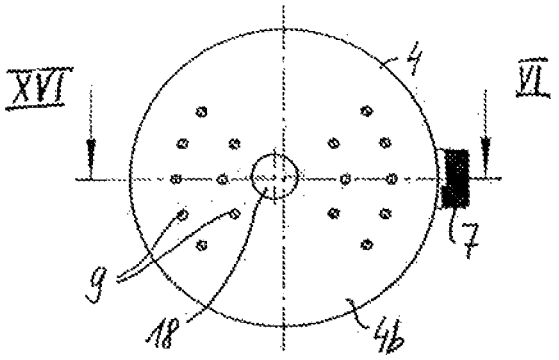
Figure 4:
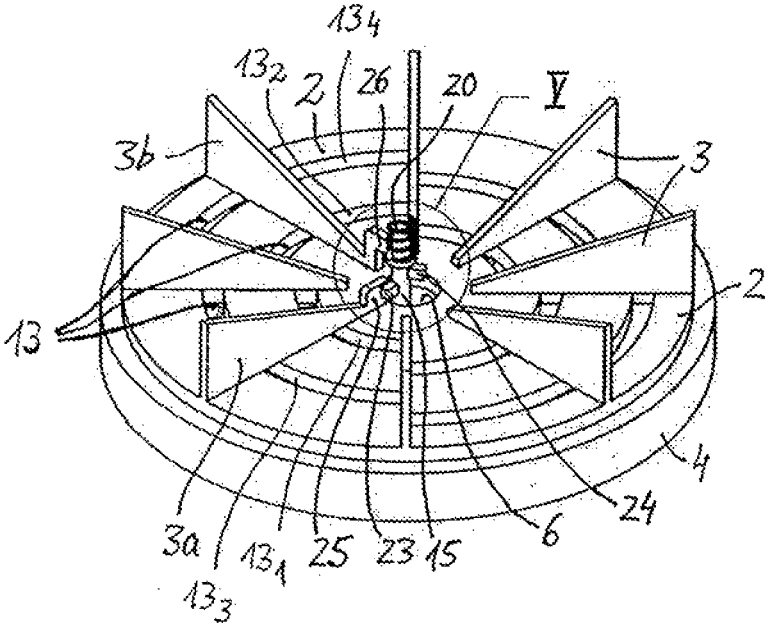
Figure 5:
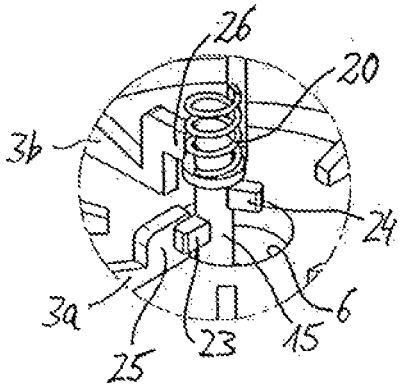
Figure 6:
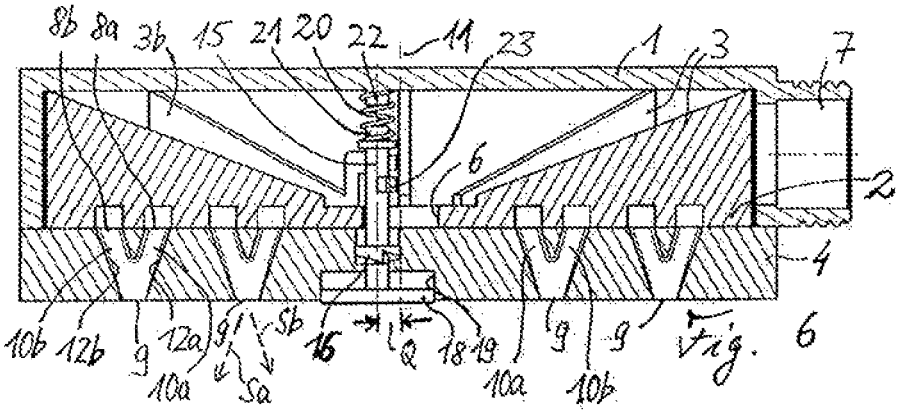
Figure 7:
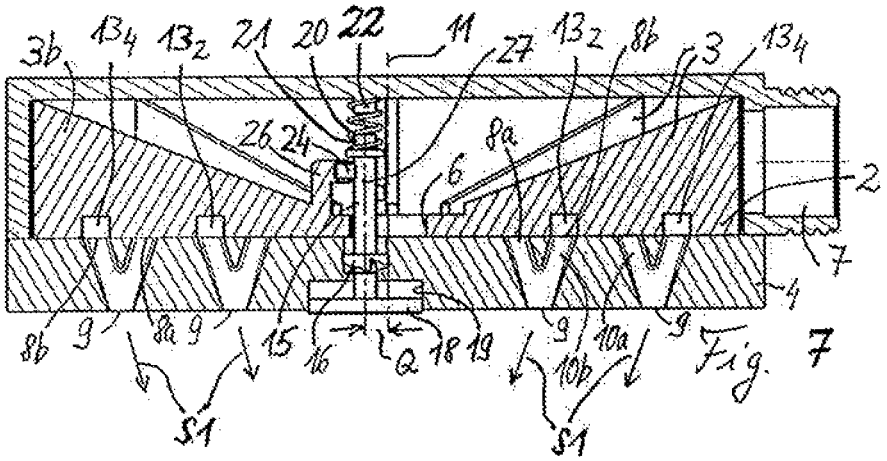
Figure 8:
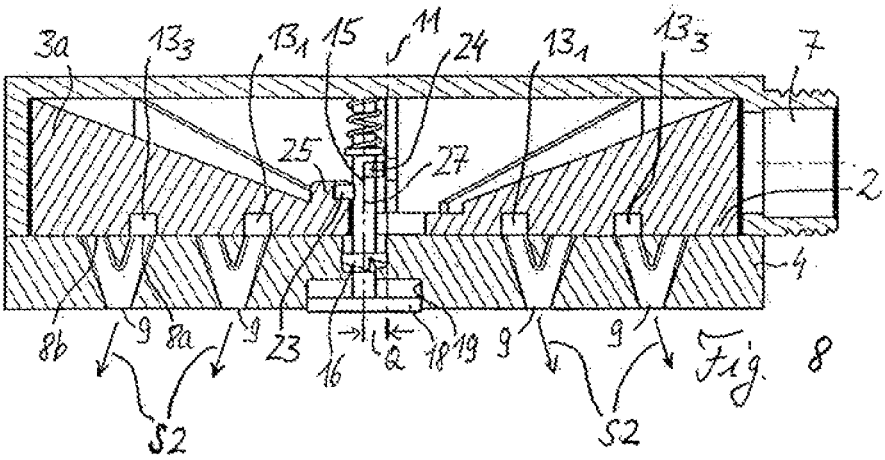
Figure 9:
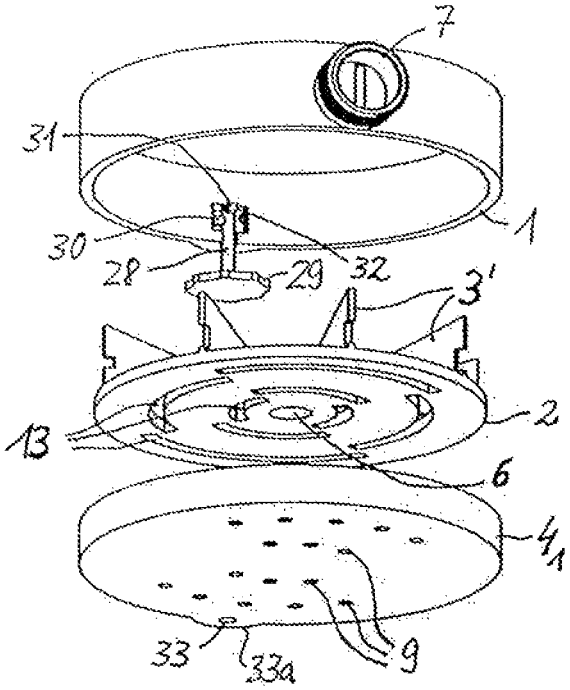
Figure 10:
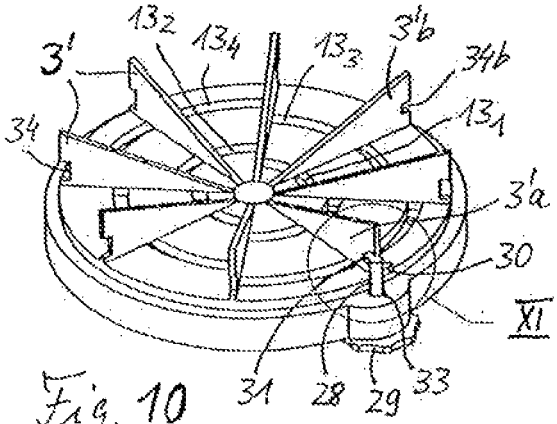
Figure 11:
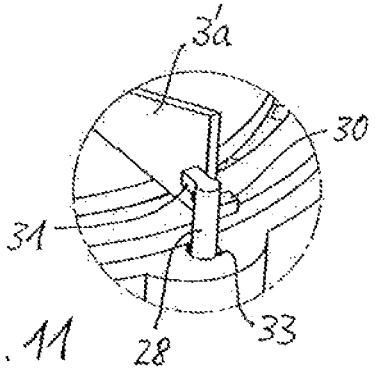
Figure 16:
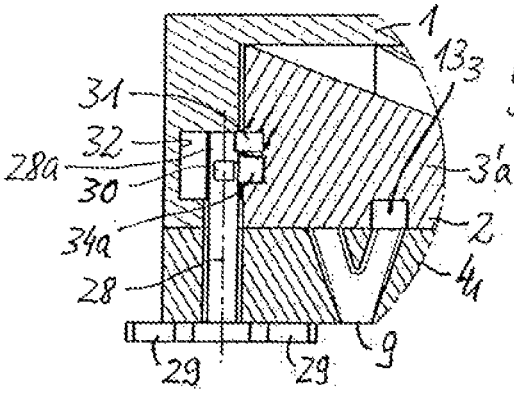
Figure 17:
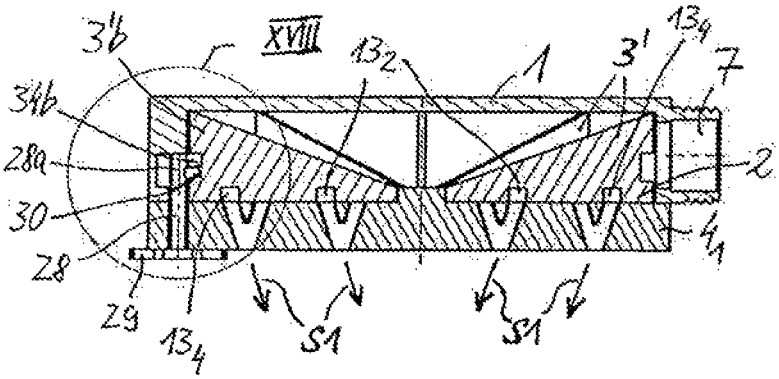
Figure 18:
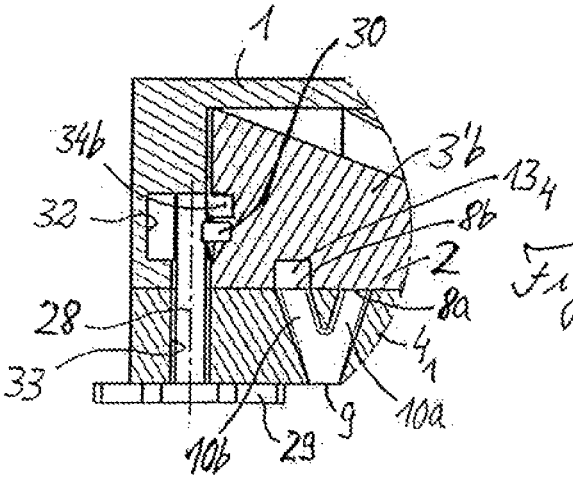
Figure 19:
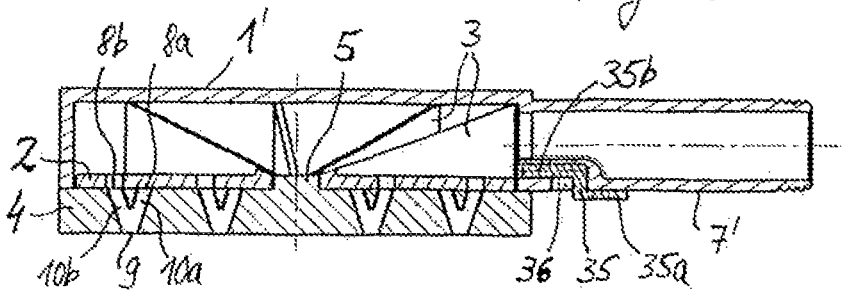
Figure 20:
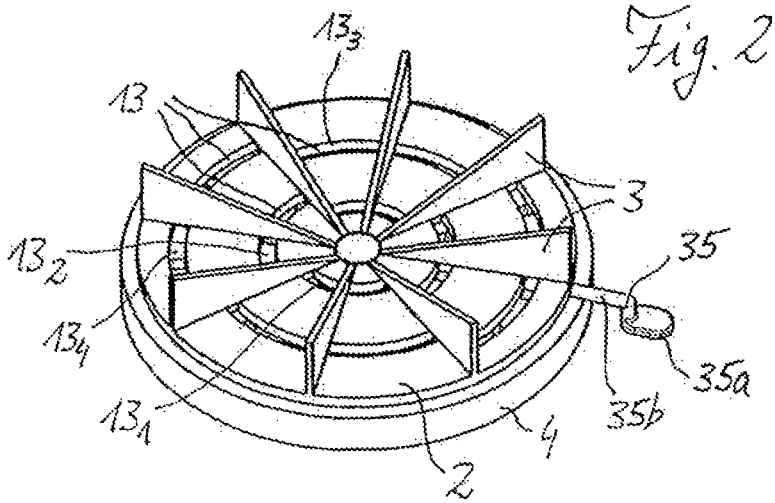
Figure 21:
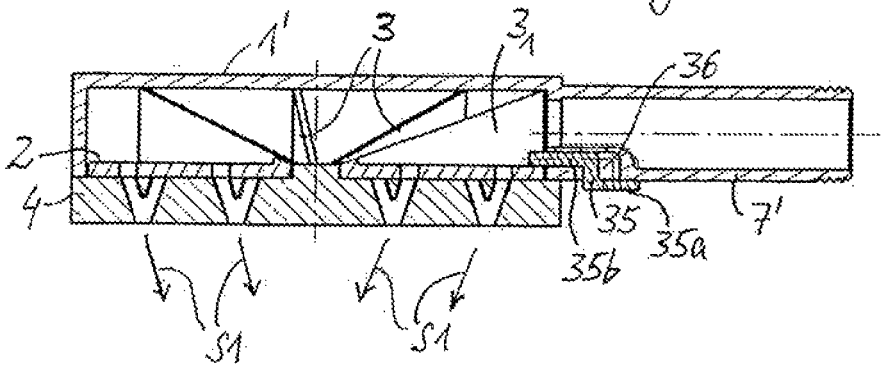
Figure 22:
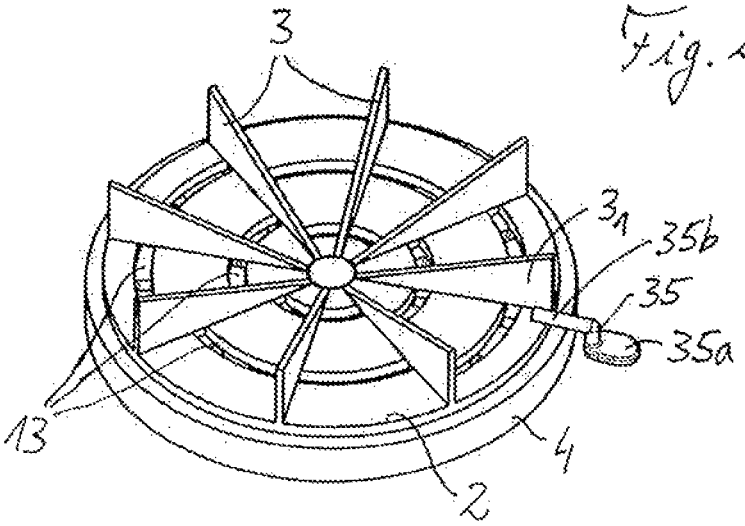

Advantageous embodiments of the invention are illustrated in the drawings and will be described below. In the drawings:

FIG. 1 shows a perspective exploded view from above of a first shower head with a blocking mechanism arranged in a central region, FIG. 2 shows a perspective exploded view from below of the shower head from FIG. 1, FIG. 3 shows a plan view from below of the shower head from FIG. 1, FIG. 4 shows a perspective view of the shower head of FIG. 1 with the shower head housing removed, FIG. 5 shows a detail view of a region V in FIG. 4, FIG. 6 shows a sectional view along a line VI-VI in FIG. 3 with the blocking mechanism in a release position, FIG. 7 shows the view of FIG. 6 in a first blocking position for a first shower jet characteristic, FIG. 8 shows the view of FIG. 6 in a second blocking position of the blocking mechanism for a second shower jet characteristic, FIG. 9 shows a perspective exploded view from below of a second shower head with a blocking mechanism arranged in an edge region, FIG. 10 shows a perspective view from above of the shower head of FIG. 9 with the shower head housing removed, FIG. 11 shows a detail view of a region XI in FIG. 10, FIG. 12 shows a plan view from below of the shower head of FIG. 9, FIG. 13 shows a sectional view along a line XIII-XIII in FIG. 12 with the blocking mechanism in a release position, FIG. 14 shows a detail view of a region XIV in FIG. 13, FIG. 15 shows the view of FIG. 13 in a first blocking position of the blocking mechanism, FIG. 16 shows a detail view of a region XVI in FIG. 15, FIG. 17 shows the view of FIG. 13 in a second blocking position of the blocking mechanism, FIG. 18 shows a detail view of a region XVIII in FIG. 17, FIG. 19 shows a longitudinal sectional view of a third shower head with a blocking/actuation pin, arranged in radially movable fashion a connection/handle region of a shower head housing, in a release position, FIG. 20 shows a perspective view of control disc and jet disc of the shower head of FIG. 19 with the blocking/actuation pin, FIG. 21 shows a view corresponding to FIG. 19 in a blocking position of the blocking/actuation pin, and FIG. 22 shows a view corresponding to FIG. 20 in the blocking position of the blocking/actuation pin.

A shower head shown as a first exemplary embodiment according to the invention in FIGS. 1 to 8 comprises a pot-shaped shower head housing 1, a control disc 2 which is accommodated in said shower head housing and which has a turbine blade structure 3 formed integrally on an inner side 2*a*, and a jet disc 4 which bears by way of an inlet side 4*a* against the outer side of the control disc 2. The jet disc 4 is rigidly connected to the housing 1, and the control disc 2 is held, rotatably relative to said housing, in the shower head interior formed by the housing 1 and by the jet disc 4.

The shower head housing 1 has a fluid inlet 7 on the side, that is to say on the circumference. In a manner known per se, the inlet 7 is assigned, on the inside of the housing 1, a flow-guiding structure by means of which the fluid supplied via the inlet 7 is directed onto the turbine blade structure 3 with a circumferential direction component, whereby the control disc 2 is set in rotation. In this way, the supplied fluid flow, which in the case of a sanitary shower device is a water flow, is utilized as a drive medium which sets the control disc 2 in rotation. The turbine blade structure 3 comprises a multiplicity of turbine blades which are arranged in distributed fashion in the circumferential direction and which run in an ascending, wedge-shaped manner in the radial direction such that the fluid supplied via the lateral inlet 7 can be distributed across the entire housing interior.

The jet disc 4 is equipped with a multiplicity of inlet openings 8 on its inlet side 4*a* and with a multiplicity of outlet openings 9 on its outlet side 4*b*. Here, as can be seen in particular from FIGS. 6 and 8, in each case two radially adjacent inlet openings 8*a*, 8*b* issue via in each case one associated passage channel 10*a*, 10*b* into a common outlet opening 9. For this purpose, the two passage channels 10*a*, 10*b* run, with longitudinal axes inclined relative to one another, through the jet disc 4 from the inlet side 4*a* thereof to the outlet side 4*b* thereof. In the example shown, the longitudinal axes of every two passage channels 10*a*, 10*b* that lead from two radially adjacent inlet openings 8*a*, 8*b* to a common outlet opening 9 are inclined relative to a longitudinal axis 11 of the shower head by the same angle, for example by an angle of between 5° and 30° Correspondingly, the two passage channels 10*a*, 10*b* leading from two radially adjacent inlet openings 8*a*, 8*b* to a common associated outlet opening 9 of the jet disc 4 have non-parallel sidewall regions 12*a*, 12*b*.

The control disc 2 is equipped with a control slot pattern 13, wherein the control slot pattern 13 and the inlet openings 8 of the jet disc 4 are coordinated with one another such that, as the control disc 2 rotates, the two radially adjacent inlet openings 8*a*, 8*b* that issue into a common outlet opening 9 are opened up in an alternating manner. This means that, during one full rotation of the control disc 2, the control slot pattern 13 thereof opens up one of the two adjacent inlet openings 8*a*, 8*b* over a certain first angle range, and opens up the other of the two inlet openings 8*a*, 8*b* over a certain second angle range that differs from the first angle range, while covering the respective inlet opening, that is to say keeping the respective inlet opening closed, over the remaining angle range.

In the exemplary embodiment shown, the jet disc outlet openings 9 are arranged at two different radii, with a first group of six outlet openings 9 on an inner radius, and a second group of ten outlet openings 9 on an outer radius. Correspondingly, on the inlet side 4*a* of the jet disc 4, six pairs of radially adjacent inlet openings 8*a*, 8*b* are arranged in a region situated radially further toward the inside, and ten pairs of radially adjacent inlet openings 8*a*, 8*b* are arranged in a region situated radially further toward the outside. The inlet openings 8 are therefore situated along a total of four different radii. Correspondingly, the control slot pattern 13 of the control disc 2 has slot regions $\mathbf{13}_1$, $\mathbf{13}_2$, $\mathbf{13}_3$, $\mathbf{13}_4$ arranged on four different radii, said slot regions being in the form of slot ring segments, these also being referred to for short in the present case as slot segments. For each of the four radii, there are provided in each case two slot segments $\mathbf{13}_1$ to $\mathbf{13}_4$ which extend in each case over an angle range of 90° and are separated from one another by means of in each case two non-slotted 90° sectors. Here, the slot segments $\mathbf{13}_1$, $\mathbf{13}_2$ and $\mathbf{13}_3$, $\mathbf{13}_4$ which are respectively associated with the paired inlet openings 8*a*, 8*b* and which are correspondingly situated on respectively adjacent radii are arranged offset relative to one another by 90°, such that, of the two paired inlet openings 8*a*, 8*b*, in each case one is opened up by the control slot pattern 13 and the other is covered.

In alternative embodiments, an overlap of the slot ranges may be provided such that, of the paired inlet openings 8*a*, 8*b* that issue into the same outlet opening 9, in each case one is already at least partially opened up before the other is fully covered. Depending on the configuration of such an overlap range, it is possible to achieve a more abrupt or more uniform transition between the correspondingly different shower jet characteristics.

Furthermore, in the exemplary embodiment shown, the slot segments $13_1$, $13_3$ belonging to the innermost radius and to the third-innermost radius, and thus in each case to the radially inner inlet openings 8*a* of the inlet opening pairs 8*a*, 8*b*, are arranged without an offset in the circumferential direction. The slot patterns $13_2$, $13_4$ of the second-innermost and of the outermost radii, which slot patterns correspond to the outer inlet openings 8*b* of the inlet opening pairs 8*a*, 8*b*, are likewise arranged without an offset in the circumferential direction.

As can also be seen from FIGS. 1 to 3, in the case of this shower head, the inlet openings 8 and thus also the corresponding outlet openings 9 are arranged not so as to be distributed over the entire circumference of the jet disc 4 but rather are restricted to two opposite sectors each extending over an angle range of approximately 90°. This results in a shower jet characteristic which is variable with time and which, as the control disc 2 rotates, alternates between two different jet patterns S1, S2 that are shown in FIGS. 7 and 8.

In other words, the coordination of the control slot pattern 13 and inlet openings 8 selected in the exemplary embodiment of FIGS. 1 to 8 has the effect that the shower jet characteristic changes in each case after the control disc 2 has rotated through 90°, the overall result being two different shower jet characteristics, each of which occurs two times during one full rotation of the control disc 2. This is because, owing to the non-parallel side wall regions 12*a*, 12*b* of the two passage channels 10*a*, 10*b* that connect two radially adjacent inlet openings 8*a*, 8*b* to an outlet opening 9, the fluid that is conducted through the jet disc 4 has, after emerging from the respective outlet opening 9, a different resulting jet outlet direction Sa, Sb depending on whether the fluid passes to the respective outlet opening 9 through one, for example radially inner, inlet opening 8*a* or through the other, for example radially outer, inlet opening 8*b*. The jet outlet directions Sa, Sb are substantially parallel to the side wall regions 12*a*, 12*b* of the passage channels 10*a*, 10*b* because said side wall regions 12*a*, 12*b* serve as guide surfaces or flow-guiding surfaces along which the fluid is guided from the inlet side 4*a* to the outlet side 4*b* of the jet disc 4. Each pair of radially adjacent inlet openings 8*a*, 8*b* thus provides two possible jet outlet directions Sa, Sb for the associated outlet opening 9.

FIGS. 7 and 8 show two different rotary position situations of the control disc 2. In the position of FIG. 7, the control disc 2, by way of its control slot pattern 13, opens up in each case the radially outer inlet opening 8*a* of the four inlet opening pairs that are visible in this sectional view, said inlet opening pairs being situated along a diameter line of the jet disc 4. This results in a jet pattern S1 in which the outlet jets emerge with a radially inwardly directed component. In the position of FIG. 8, the control disc 2 opens up the inlet openings in a manner complementary to FIG. 3, that is to say the radially inner inlet openings 8*b* of the inlet opening pairs that are shown. This leads to a jet pattern S2 in which the two jets emerge with a radially outwardly directed component.

During operation, the fluid, such as water if the shower head is used for a sanitary shower device, passes via the inlet 7 into the interior of the shower head housing 1, sets the control disc 2 in continuous rotation in the process owing to the turbine blade structure 3 of said control disc, and passes through the slots of the control slot pattern 13 into the respectively opened-up inlet openings 8 of the jet disc and through the passage channels 10*a*, 10*b* to the outlet openings 9, in order to emerge from there with a shower jet characteristic that varies with time correspondingly to the rotating control disc 2, as explained above.

By means of corresponding dimensioning and arrangement of the various slot segments $13_1$ to $13_4$ of the control slot pattern 13, it is possible to set a desired defined temporal sequence of the present jet direction for the various outlet openings 9 with respect to one another, as is clear from the above explanations relating to FIGS. 7 and 8. The overall result is thus a variation with time of the shower jet characteristic for the fluid emerging from the shower head via the outlet openings 9, without the need for any movable jet outlet elements for this purpose. Instead, the arrangement of the control disc 2 so as to be movable relative to the jet disc 4 is sufficient, said control disc being the only movable jet-forming element of the shower head in the exemplary embodiment shown in FIGS. 1 to 8. Alternatively, movable jet outlet elements may self-evidently additionally be provided if required. In further alternative embodiments, the jet disc may form the element that is actively set in rotation, with the control disc remaining static.

In a shower head variant according to the invention which is not shown, in each case two adjacent inlet openings correspond individually with two correspondingly adjacent outlet openings, wherein separate passage channels are provided for connecting each inlet opening to its corresponding outlet opening. In this exemplary embodiment, the passage channels extend as rectilinear bores from the respective inlet opening to the respective outlet opening through a jet disc which is modified in this regard. Thus, in the case of this shower head, the outlet openings correspond in terms of number and arrangement to the inlet openings.

The jet pattern variation with time is realized in the case of this variant in that, as the control disc rotates, the control slot pattern thereof, by way of the various slot segments, opens up and blocks the two inlet openings of each pair of radially adjacent inlet openings in an alternating, that is to say successive, manner, such that as a result, the fluid emerges alternately from one and from the other of the two corresponding, radially adjacent outlet openings. In other words, in the case of this shower head, the variation with time of the shower jet characteristic for each pair of radially adjacent inlet openings arises in that the fluid jet emerges in a periodically alternating manner from one or from the other of the two corresponding adjacent outlet openings, whereas in the case of the shower head of FIGS. 1 to 8, the jet pattern variation is based on a change in the direction in which the fluid jet emerges from the respective common outlet opening.

The shower head of FIGS. 1 to 8 furthermore has a blocking mechanism which makes it possible for the control disc 2 to be blocked against further rotation, and thus for said control disc to be immobilized selectively in the position of FIG. 7, with the jet pattern S1, or in the position of FIG. 8, with the jet pattern S2, according to user demand. Specifically, the blocking mechanism in this example is designed, so as to be manually operable, as a combined push/turn mechanism, such as is known for example from ball-point pens. For this purpose, the blocking mechanism has a blocking/actuation pin 15 with a suitably profiled pin head 16 which is guided in a recess 17 on the inlet side 4*a* of the jet disc 4 and which is acted on by a pushbutton 18, the latter being inserted from the outside into a recess 19 on the outer side of the jet disc 4 and being connected to the pin head 16.

The actuating pin 15 extends eccentrically through a central opening 6 of the control disc 2 and, via a helical spring 20, is supported resiliently elastically against the inner side of the upper part of the shower head housing 1. For this purpose, the spring 20 is held at one side on a foot part 21 of the actuating pin 15 and at the other side on a bearing projection 22 of the housing inner side. If the user presses the pushbutton 18, the latter moves the actuating pin 15 axially forward, or upward in FIGS. 1 to 8, counter to the force of the helical spring 20. The axial movement of the actuating pin 15 results, owing to interaction of the profiled pin head 16 with a corresponding profile in the head receptacle 17 of the jet disc 4, in a rotation of the actuation pin 15 through 90°. When the pushbutton 18 is released, the helical spring 20 pushes the actuating pin 15 together with pushbutton 18 axially back into the initial position, wherein, during said axial return movement, the actuating pin 15 remains in its rotary position assumed as a result of the preceding axial forward movement.

On its circumference, the actuating pin 15 is equipped, between the head part 16 and the foot part 21, with two radially projecting blocking stops 23, 24 which are arranged so as to be offset relative to one another by approximately 90° in the circumferential direction and by more than their axial extent in the axial direction, such that said blocking stops do not overlap either in the circumferential direction or in the axial direction.

Correspondingly to said blocking stops 23, 24, two of the turbine blades 3 have in each case one blocking lug 25, 26 extending radially inward as far as the central opening 6 of the control disc 2. The other turbine blades end at a radial distance from the central opening 6, as can be seen in FIGS. 1, 4 and 5, or duly extend as far as the central opening 6, as indicated in FIGS. 6 to 8 which are slightly modified in this regard, but have only an axial height which is so small that they cannot come into blocking contact with the blocking stops 23, 24, arranged axially thereabove, of the actuating pin 15. Specifically, a first turbine blade 3*a* has a lower blocking lug 25 which interacts with the blocking stop 23 that is situated lower down in FIGS. 1 to 8, that is to say closer to the head part 16. Said blocking lug 25 ends, on the axially upward direction, before the blocking stop 24 which is situated further above, that is to say closer to the foot part 21, such that said blocking lug 25 does not interact with said blocking stop 24 so as to block the control disc rotary movement. A second turbine blade 3*b* has an upper delimiting lug 26 which interacts with the upper delimiting stop 24 of the actuating pin 15 and which ends, on the axially downward direction, before the lower delimiting stop 23. As a result, the turbine blade 3*b* interacts, at its radially inner side and by means of its upper blocking lug 26, only with the upper blocking stop 24 of the actuation pin 15, whereas, regardless of the rotary position of the actuation pin 15, said turbine blade 3*b* does not interact with the lower blocking stop 23 of said actuation pin.

As can be seen from FIGS. 6 to 8, the actuation pin 15 is arranged in the central region of the shower head with a predefinable transverse offset Q with respect to the longitudinal centre of the shower head, that is to say the longitudinal axis 27 of said actuation pin has a parallel offset, of corresponding dimension Q, with respect to the shower head longitudinal axis 11. Said offset is coordinated with the radial extent of the blocking stops 23, 24 and of the corresponding blocking lugs 25, 26 such that the respective blocking stop 23, 24 interacts with the corresponding blocking lug 25, 26 so as to generate a blocking action only when the actuation stop 23, 24 is situated on the side of the actuating pin 15 situated diametrically opposite the shower head longitudinal central axis 11. The respective blocking stop 23, 24 can be moved into said position by means of the stated combined axial/rotary movement.

FIG. 6 shows the actuation pin 15 in a rotary position in which neither of its two blocking stops 23, 24 is in a blocking position on the side facing away from the shower head longitudinal central axis 11. Consequently, in this position of the blocking pin 15, the control disc 2 with its turbine blade structure 3 can rotate freely. Here, the control disc 2 is supported radially to the outside and in the axially upward direction on the housing 1, and in the axially downward direction on the jet disc 4. Thus, in the actuation pin position of FIG. 6, the control disc 2 rotates continuously during operation, resulting in the above-mentioned variation with time of the shower jet characteristic in the form of alternation between the jet patterns S1 and S2 as per FIGS. 7 and 8.

If, proceeding from this release position of the blocking mechanism, the user actuates the pushbutton 11 once, the actuation pin 15 subsequently assumes a position rotated through 90°counterclockwise, as shown in FIG. 7. In this position, the upper blocking stop 24 is situated in its blocking position facing away from the shower head longitudinal axis 11. As a result, said blocking stop blocks the rotation of the control disc 2 when the respective turbine blade 3*b* with the upper blocking lug 26 comes into contact with said upper blocking stop 24, as illustrated in FIG. 7. The control disc 2 thereupon comes to a standstill in said position, such that the fluid then emerges from the shower head with the static jet pattern S3, with no variation with time.

If the user thereupon actuates the blocking mechanism once again by means of the pushbutton 18, the actuating pin 15 arrives in a position rotated still further counterclockwise by approximately 90°, as shown in FIG. 8, in which position the lower blocking stop 23 assumes its blocking position facing away from the shower head longitudinal central axis 11. In said blocking position, the lower blocking stop 23 interacts with the lower blocking lug 25 of the respective turbine blade 3*a* so as to generate a blocking action. At the same time, owing to the further rotation of the actuation pin 15, the upper blocking stop 24 passes from its previous blocking position into its release position, whereby its blocking interaction with the upper blocking lug 26 is eliminated. The control disc 2 consequently rotates further out of its blocking position of FIG. 7 until the turbine blade 3*a* comes into contact, by way of its lower blocking lug 25, with the lower blocking stop 23 of the actuation pin 15. The rotation of the control disc 2 thereupon stops again, and the shower head delivers the other jet pattern S2 of FIG. 8 as a constant shower jet characteristic.

By pressing the pushbutton 18 again, the user can again eliminate the blocking position of FIG. 8 with the static jet pattern S2. Owing to the further rotation of the actuation pin 15, again through approximately 90°, effected by the push-action actuation, the lower blocking stop 23 passes into its release position in which it no longer interacts with the lower blocking lug 25 of the turbine blade 3*a*. On the other hand, after said further rotation of the actuation pin 15, the upper delimiting stop 24 remains in its release position, such that the control disc 2 can then rotate freely. In other words, by a single actuation of the blocking mechanism, the user switches from the blocking position of FIG. 8 into the release position in which the freely and continuously rotating control disc serves to provide the described alternation between the jet patterns S1 and S2.

FIGS. 9 to 18 illustrate a second shower head according to the invention which, aside from a variant of the blocking mechanism, substantially corresponds to the first shower head according to the invention of FIGS. 1 to 8, wherein the same reference signs are used for identical and functionally equivalent elements, and in this respect reference can be made to the above description relating to the first shower head.

In the case of the shower head of FIGS. 9 to 18, the blocking mechanism for blocking the control disc rotary movement includes a blocking/actuation pin 28 which is inserted, for encircling rotary movement, into an edge-side through bore 33 of a jet disc $4_1$ which is modified in this respect in relation to the jet disc 4 of the first shower head. For this purpose, the jet disc $4_1$ has a protuberance 33*a* on its circumference, in the region of which protuberance the through bore 33 is situated and against the axial outer side of which protuberance bears a knurled head 29 of the actuation pin 28, by means of which knurled head a user can rotate the actuation pin 28. For this purpose, the knurled head 29 protrudes radially slightly beyond the circumference of the shower head housing 1 and of the jet disc $4_1$. To assist in realizing the rotatably movable mounting of the control disc 2 in the shower head housing 1, a cylindrical bearing projection 5 formed on the inlet or inner side 4*a* of the jet disc $4_1$ engages into the corresponding central opening 6 of the control disc 2.

The actuation pin 28 projects by way of a foot part 28*a* into a side wall region of the housing 1, for which purpose the housing side wall has a matching recess 32 in which the foot part 28*a* of the actuation pin 28 is received. At its foot part 28*a*, the actuation pin 28 is equipped, similarly to the actuation pin 15 of the third shower head, with two blocking stops 30, 31 which project radially from the circumference and which are arranged one behind the other by 90° in the circumferential direction and in the axial direction. The recess 32 on the side wall of the housing 1 is dimensioned such that the blocking stops 30, 31 of the actuation pin 28 can rotate unhindered therein when the actuation pin 28 is rotated.

In the case of this second shower head, the blocking function is realized in that each of the two blocking stops 30, 31 of the actuation pin interacts, so as to generate a blocking action, with the radially outer side of in each case one of the turbine blades of a turbine blade structure 3', which is modified in this regard, of the control disc 2. Specifically, a turbine blade 3'*a* interacts with the upper blocking stop 31 in the Figures, which is at the foot side in the axial direction, when said blocking stop is situated in a radially inwardly pointing position, and a turbine blade 3'*b* interacts with the lower blocking stop 30 in the Figures, which is situated closer to the knurled head 29, when said blocking stop is situated in its radially inwardly pointing position.

For this purpose, all of the other turbine blades 3' are equipped, on their radially outer side, with a first, relatively broad recess 34 which is dimensioned such that the turbine blades 3' equipped with said recess 34 can rotate freely past the actuation pin 28 in any position of the latter, even if one of the blocking stops 30, 31 of said actuation pin is situated in the radially inwardly pointing blocking position. Here, the blocking stop 30, 31 passes the recess 34 in each case, which recess, for this purpose, extends axially at least over the entire axial length of both blocking stops 30, 31. By contrast, the turbine blade 3'*a* has, on its radial outer side, a relatively narrow lower recess 34*a* which is dimensioned such that, although the lower blocking stop 30 can pass through said recess 34*a* when said blocking stop is situated in its radially inwardly pointing blocking position, the upper blocking stop 31 however cannot. Similarly, the turbine blade 3'*b* is equipped with an upper relatively narrow recess 34*b* which is dimensioned such that, although the upper blocking stop 31 of the actuation pin 28 can pass through when said blocking stop is situated in its radially inwardly pointing blocking position, the lower blocking stop 30 however cannot.

This configuration yields the following mode of operation of said blocking mechanism. In a release position as illustrated in FIGS. 13 and 14, the actuation pin 28 is situated in a rotary position in which neither of its two blocking stops 30, 31 assumes its radially inwardly pointing blocking position, and instead both blocking stops 30, 31 are situated within the recess 32 of the housing side wall without projecting radially inward from the housing side wall. As a result, the turbine blade structure 3', and with it the control disc 2, can collectively rotate unhindered, with the result that, in this operating mode of the shower head, the above-explained variation with time of the shower jet characteristics is obtained.

If, proceeding from said state, the user, during operation of the shower head, wishes to maintain one of the various shower jet characteristic in a constant state, he can for this purpose rotate the actuation pin 28, by way of its knurled head 29, into a corresponding blocking position. FIGS. 15 and 16 illustrate a blocking position in which the turbine blade 3'*a* interacts with the radially inwardly pointing, upper blocking stop 31 so as to generate a blocking action. For this purpose, the user rotates the actuation pin 28 clockwise through 90° proceeding from the release position shown in FIGS. 13 and 14. Whereas all of the other turbine blades 3' and 3'*b* can rotate freely past the radially inwardly pointing blocking stop 31, the turbine blade 3'*a* abuts against the blocking stop 31, whereby the rotary movement of the control disc 2 is stopped. The turbine blade 3'*a* is selected such that, in said blocking position, the control disc 2, by way of the associated slot segments $13'_1$, $13'_3$, opens up in each case the radially inner inlet openings 8*a* of the inlet openings 8*a*, 8*b* that are adjacent to one another in pairs, thus giving rise to the outlet jet pattern S2, similarly to FIG. 8 in the case of the first shower head.

If the actuation pin 28 is rotated still further clockwise through 90°, it assumes its second blocking position in which its lower blocking stop 30 points radially inward and is abutted against by the turbine blade 3'*b*, as shown in FIGS. 17 and 18, whereas all of the other turbine blades 3' and 3'*a* can freely pass the radially inwardly pointing blocking stop 30. The turbine blade 3'*b* is again selected such that the control disc 2, when immobilized in said second blocking position, provides the outlet jet pattern S1 in a constant state, similarly to FIG. 7 in the case of the first shower head, by virtue of the corresponding slot segments $13_2$, $13_4$ of the control slot pattern 13 opening up in each case the radially outer inlet opening 8*b* of the inlet openings 8*a*, 8*b* that are radially adjacent one another in pairs.

If the blocking pin 28 is once again rotated further clockwise through 90°, the two blocking stops 30, 31 are then again situated within the recess 32 of the housing side wall without protruding radially inward, that is to say the blocking mechanism is again situated in its release position in which the control disc 2 can rotate unhindered in order to realize the desired variation with time of the shower jet characteristic.

FIGS. 19 to 22 illustrate a third shower head according to the invention which, aside from a variant of the blocking mechanism, substantially corresponds to the first and second shower head according to the invention of FIGS. 1 to 18, wherein again, the same reference signs are used for identical and functionally equivalent elements, and in this respect, reference may be made to the above description relating to the first shower head.

The shower head of FIGS. 19 to 22 has a housing 1' which is modified such that a connector region 7', which is in the form of a pipe connection piece that is elongated in relation to the fluid inlets 7 of the shower heads of FIGS. 1 to 18, functions as a fluid inlet. The pipe connection piece 7' may simultaneously serve as a handle region of the shower head or may be part of such a handle region, at which the user grips the shower head by hand. The connection piece 7' may, as shown, be provided on the inlet side with a connection thread, such as an external thread, for a shower hose to be screwed on.

Furthermore, the shower head of FIGS. 19 to 22 differs from that of FIGS. 1 to 18 by a modified blocking mechanism. In this exemplary embodiment, the blocking mechanism for blocking the control disc rotary movement includes a blocking/actuation pin 35 which is guided in a radially movable fashion in a corresponding pin receptacle 36 which is formed, on an underside of the connection piece 7', at the transition to the housing part in which the control disc 2 is accommodated.

The actuation pin 35 has an actuation part 35*a* and has a pin part 35*b* which is angled upward in an offset manner, and points radially inward, from said actuation part. In this exemplary embodiment, the radial direction refers to that of the control disc 2 and of the jet disc 4. Here, the stated radial mobility of the actuation pin 35 refers to mobility or displaceability of said actuation pin with a radial component. Consequently, this need not imperatively be a purely radial movement, and instead may also be a combined movement in the radial and circumferential directions of the control disc 2 or jet disc 4. In this respect, it is essential merely that the actuation pin 35 can, by means of said radial mobility, enter into operative engagement with the control disc 2 or with the turbine blade 3 thereof in order to be able to stop the rotary movement of the control disc as required. For this purpose, in the example shown, the pin part 35*b* of the actuation pin 35 is situated, at the level of the turbine blade 3, directly above that part of the control disc 2 which has the control slot pattern 13.

The control part 35*a* of the actuation pin 35, which control part is in the form of an oval, disc-shaped control surface in the example shown, is situated at the outside on the underside of the connection piece 7' with a small spacing to the jet disc 4. Said position of the control part 35*a* is visually and haptically advantageous. By means of the control part 35*a*, the user can actuate the actuation pin 35 very easily, for example using one finger of the hand that is gripping the shower head, by sliding the control part 35*a* forward slightly in the direction of the jet disc 4, or sliding said control part back again, along the underside of the connection piece. For this purpose, the pin receptacle 36 has a cutout of adequate length in the axial direction of the connection piece 7' such that the actuation pin 35 can be moved forward and backward in a guided manner in the cutout.

FIGS. 19 and 20 show the blocking mechanism with the blocking/actuation pin 35 in a release position in which the actuation pin 35 is situated with its pin part 35*b* radially outside the control disc 2 with the turbine blades 3. Consequently, in this release position of the actuation pin 35, the control disc 2 can rotate freely.

FIGS. 21 and 22 show the shower head with the actuation pin 35 having been slid forward into a blocking position. In said blocking position, the actuation pin 35 engages by way of its pin part 35*b* into the radial region of the control disc 2 with its turbine blades 3. As a result, the control disc rotary movement is stopped when one of the turbine blades 3 abuts laterally against the pin part 35. In this regard, FIGS. 21 and 22 illustrate the way in which a turbine blade $\mathbf{3}_1$ abuts against the pin part 35*b*, specifically at its right-hand side as viewed in the radially inward direction, and thus the control disc rotary movement is stopped when the control disc 2 has first rotated clockwise as viewed from above.

In said blocking position, it is then again the case, as in the other exemplary embodiments that have been explained, that a particular associated jet pattern of the fluid emerging from the shower head is maintained in a constant state, for example, as shown, the jet pattern S1 corresponding to FIGS. 7 and 17. By sliding the actuating pin 35 back out of said blocking position into the release position, the user can end the adherence to the constant jet pattern and can operate the shower head again with the control disc rotating and thus with a jet pattern that alternates with time.

In the embodiment shown in FIGS. 19 to 22, the actuation pin 35 can interact with any of the turbine blades 3 so as to generate a blocking action. Thus, by means of this blocking mechanism, the jet pattern that is set constant is that which is present at the moment in which the blocking/actuation pin 35 is actuated into its blocking position. During operation with the jet pattern that varies with time, the user can observe the change in the jet pattern and slide the actuation pin 35 into the blocking position at the exact moment when the specific jet pattern that he wishes to maintain in a constant state appears.

In alternative design variants, suitable selective blocking structures may be provided on the turbine blades 3 or on the control disc 2 itself and/or on the actuation pin 35, analogously to the exemplary embodiments of FIGS. 1 to 18, in order for the control disc rotary movement to be stopped in a targeted manner in one or more blocking positions that each correspond to desired jet patterns.

For example, in a corresponding embodiment, all of the turbine blades 3 with the exception of one turbine blade may be equipped with a slotted recess on its radially outer side, such that said turbine blades can pass the pin part 35*b* unhindered even when the actuation pin 35 is situated in the blocking position in which it has been slid radially forward. It is then only ever the turbine blade that is not provided with said recess that abuts against the pin part 35*b* of the actuation pin 35, whereby the control disc rotary movement is stopped in said position in order to maintain an associated jet pattern in a constant state. In further design variants of this, it is also possible for two or more turbine blades that correspond to different jet patterns to not be equipped with the recess that passes the actuation pin. In this case, it is then again possible for the user to select between multiple constant jet patterns by sliding the actuation pin from the release position into the blocking position at a respectively suitable time.

In further alternative design variants, the blocking/actuation pin 35 is equipped, in its region that interacts with the control disc 2 or with the turbine blades 3, with a multiplicity of blocking stops similar to those of the exemplary embodiments in FIGS. 1 to 18, in combination with suitable blocking structures on the control disc 2 and/or on the turbine blades 3, in order to make it possible for different jet patterns to be set constant in a targeted manner independently of the time at which the blocking/actuation pin 35 is actuated.

As is clear from the above description of advantageous exemplary embodiments, depending on the number and arrangement of the control slots and of the inlet openings, it is possible, for the entirety of the outlet openings at a respective point in time, to set identical jet directions synchronously or different jet directions in grouped fashion or different jet directions in irregularly distributed fashion, which jet directions together yield the respectively present jet pattern of the shower head. Depending on the configuration, each control slot passes over the paired inlet openings in a continuously transitioning or abruptly alternating manner so as to yield a continuous or abrupt alternation from one jet pattern to the other.

As is also clear from the exemplary embodiments shown and explained above, the invention advantageously provides a shower head which makes it possible, by means of a control disc that is movable relative to a jet disc and by means of suitable coordination of a control slot pattern provided in the control disc and of inlet openings provided in the jet disc, which inlet openings correspond with jet disc outlet openings via suitable passage channels, to achieve a desired shower jet characteristic that varies with time, without the need to provide movable jet outlet elements for this purpose. For this purpose, the passage channels may be formed with oblique side walls as flow-guiding surfaces, and/or pairs of closely adjacent inlet openings and corresponding outlet openings may be provided which are fed with the fluid in alternating fashion.

The control disc may, by means of a suitable turbine blade structure, be driven by the inflowing fluid itself. Provision may optionally be made of a planetary gear set with a step-down transmission ratio or of some other gear mechanism, known per se for this purpose, with step-up or step-down transmission ratio. Detailed further variants with regard to design of the control disc, of the jet disc and of gear mechanisms are disclosed in a German patent application having the same priority (DE 10 2013 207 679.7), the entire content of which is hereby incorporated into the present application by reference. Furthermore, in a manner which is not shown, a conventional rotational speed regulation means may be provided for the control disc, for example by way of a bypass past turbine drive nozzles, as described for example in the patent EP 0 900 597 B1.

It is advantageously possible according to the invention for the control disc to be stopped in a desired position such that a particular desired shower jet characteristic can be maintained in a constant state. In the case of the blocking mechanisms described, this is realized by means of a mechanical lock which interacts with suitably designed turbine blades. It is alternatively possible for corresponding mechanical blocking means to be provided not on the turbine blades but directly on the control disc, or to interact directly with said control disc. Depending on requirements, the blocking mechanism may be configured such that it can immobilize the control disc in its relative position with respect to the jet disc in two blocking positions, as shown, or alternatively in only one blocking position or in more than two blocking positions. Said blocking mechanism may also be provided in the case of shower heads which do not have a turbine blade structure and in which the relative movement of control disc and jet disc is effected by other, conventional fluid drive means. The invention furthermore encompasses embodiments in which the blocking mechanism comprises other manually operable blocking means instead of the mechanical blocking means mentioned, for example magnetic blocking means which comprise magnet elements that interact selectively with blocking or releasing action.

It is self-evident that the invention encompasses not only the examples shown by way of example but also encompasses numerous other embodiments, in particular also mixed forms of the examples shown in which features of said examples are combined, for example a jet disc with a pattern of outlet openings and inlet openings that differs from the patterns shown, and/or a control disc with a control slot pattern that differs from the control slot patterns shown, or a combination of the patterns shown.

The invention is particularly advantageously used for shower heads of sanitary shower devices. The invention is however self-evidently also suitable for all other applications in which there is a demand for a shower head with a shower jet characteristic that is variable with time.

What is claimed is:

1. A shower head, comprising:

a jet disc having fluid passage channels a control disc which is arranged so as to be rotatably movable relative to the jet disc in fluid-driven fashion and which control disc comprises a control slot pattern by which the fluid passage channels are opened up or blocked individually or group-wise depending on a rotary position of the control disc, wherein the control slot pattern and the fluid passage channels are matched to one another such that, upon rotation of the control disc relative to the jet disc, successively at least two different jet patterns are obtained for a fluid jet exiting from the jet disc, and a manually operable blocking mechanism for selectively enabling or blocking the control disc rotary movement in at least one blocking position which corresponds to an associated jet pattern.

2. The shower head according to claim 1, wherein the blocking mechanism is configured for selectively blocking rotary movement of the control disc at least in a first blocking position, which corresponds to a first jet pattern, and a second blocking position, which corresponds to a second jet pattern that differs from the first jet pattern.

3. The shower head according to claim 1, wherein the blocking mechanism includes a blocking/actuation pin which is movably attached to at least one of the jet disc and a housing of the shower head.

4. The shower head according to claim 3, wherein the blocking/actuation pin comprises a plurality of radially projecting blocking stops on its circumference, said blocking stops being disposed offset to one another in at least one of a pin circumferential direction and a pin axial direction.

5. The shower head according to claim 4, wherein the blocking stops interact with a blocking structure configured on the control disc.

6. The shower head according to claim 5, wherein the blocking structure is configured at one of a radially internal and a radially external side of turbine blades.

7. The shower head according to claim 4, wherein the blocking stops interact with a blocking structure configured on turbine blades co-rotationally coupled to the control disc.

8. The shower head according to claim 7, wherein the blocking structure is configured at one of a radially internal and a radially external side of the turbine blades.

9. The shower head according to claim 3, wherein the blocking mechanism comprises a combined push/turn mechanism for the blocking/actuation pin.

10. The shower head according to claim 9, wherein the push/turn mechanism comprises a push button which is received in an associated recess of the jet disc, for the blocking/actuation pin.

11. The shower head according to claim 3, wherein the blocking mechanism includes a rotation mechanism with a rotary actuation head projecting radially beyond at least one of the jet disc and the shower head housing.

12. The shower head according to claim 3, wherein the blocking/actuation pin is radially movably attached to one of the jet disc, a connection region and a handle region of the shower head housing.

* * * * *